US012534247B2

(12) United States Patent
Fioravanti et al.

(10) Patent No.: US 12,534,247 B2
(45) Date of Patent: Jan. 27, 2026

(54) PACKAGING MOVEMENT ASSEMBLY FOR AN AUTOMATIC PACKAGING MACHINE AND METHOD THEREOF

(71) Applicant: P.F.M. S.p.A., Torrebelvicino (IT)

(72) Inventors: Andrea Fioravanti, Torrebelvicino (IT); Marco Giovanni Pierantoni, Torrebelvicino (IT)

(73) Assignee: P.F.M. S.p.A., Torrebelvicino (IT)

( * ) Notice: Subject to any disclaimer, the term of this patent is extended or adjusted under 35 U.S.C. 154(b) by 0 days.

(21) Appl. No.: 18/925,143

(22) Filed: Oct. 24, 2024

(65) Prior Publication Data

US 2025/0128845 A1 Apr. 24, 2025

(30) Foreign Application Priority Data

Oct. 24, 2023 (IT) ..... 102023000022254

(51) Int. Cl.
*B65B 43/26* (2006.01)
*B65B 43/30* (2006.01)

(52) U.S. Cl.
CPC ..... *B65B 43/265* (2013.01); *B65B 43/305* (2013.01)

(58) Field of Classification Search
CPC ..... B65B 43/16; B65B 43/265; B65B 43/30; B65B 43/305; B65B 43/465; B65B 43/52; B65G 54/02
See application file for complete search history.

(56) References Cited

U.S. PATENT DOCUMENTS 9,505,504 B2 * 11/2016 Murray ..... B65B 43/465
10,600,441 B1 * 3/2020 Altknecht ..... G11B 17/225
10,773,845 B2 * 9/2020 Michels ..... B65B 43/54
11,091,284 B2 * 8/2021 Nakamoto ..... B65B 43/52
11,787,645 B2 10/2023 Solà Gil
2009/0158694 A1 * 6/2009 Matheyka ..... B65B 59/005 53/468

(Continued)

FOREIGN PATENT DOCUMENTS

CN 104354926 A 2/2015
CN 107410814 A 12/2017

(Continued)

OTHER PUBLICATIONS

Search Report and Search Opinion received for Italian Application No. 102023000022254, mailed on Jun. 12, 2024, 7 pages (Original Document Only).

*Primary Examiner* — Himchan Song
(74) *Attorney, Agent, or Firm* — ArentFox Schiff LLP

(57) ABSTRACT

A package movement assembly for an automatic packaging machine comprises a first trolley and a second trolley placed side by side and slidably movable along a packaging direction; a first gripping device and a second gripping device facing each other and between which a package to be moved can be positioned. The first gripping device and the second gripping device are mechanically mounted respectively on the first trolley and on the second trolley, and are movable along a direction substantially parallel to the packaging direction. Furthermore, the first trolley and the second trolley respectively comprise a vacuum pump, associated with the respective gripping device, in fluid connection with said plurality of gripping elements, and an electric motor mechanically connected to the vacuum pump and configured to actuate it.

13 Claims, 8 Drawing Sheets

(56) References Cited

U.S. PATENT DOCUMENTS

| | | | | |
|---|---|---|---|---|
| 2012/0240531 | A1* | 9/2012 | Kawamura | B65B 31/044 53/572 |
| 2013/0152516 | A1* | 6/2013 | Sammons | B65B 7/02 53/562 |
| 2016/0083130 | A1* | 3/2016 | Garriga Jimenez | B65B 61/06 53/202 |
| 2016/0122063 | A1* | 5/2016 | Garriga Jimenez | B65B 43/04 198/803.4 |
| 2018/0118393 | A1* | 5/2018 | Yoshikane | B65B 59/005 |
| 2020/0130952 | A1* | 4/2020 | Eisenberg | B65B 43/465 |
| 2022/0315356 | A1* | 10/2022 | Solà Gil | B65B 59/003 |
| 2022/0363422 | A1* | 11/2022 | Rogers | B65B 51/225 |
| 2025/0128845 | A1* | 4/2025 | Fioravanti | B65G 54/02 |

FOREIGN PATENT DOCUMENTS

| | | | |
|---|---|---|---|
| CN | 112407439 | A | 2/2021 |
| DE | 19622086 | A1 | 4/1997 |
| EP | 2788260 | A1 | 10/2014 |
| EP | 3744649 | A1 | 12/2020 |
| JP | 7345805 | B1 | 9/2023 |

* cited by examiner

PACKAGING MOVEMENT ASSEMBLY FOR AN AUTOMATIC PACKAGING MACHINE AND METHOD THEREOF

TECHNICAL FIELD

The present invention relates to a package movement assembly, in particular intended to be operatively assembled in an automatic packaging machine.

More in detail, the movement assembly according to the invention is part of the sector of production and marketing of automatic packaging machines, lines and plants, in particular of the horizontal type (HFFS) for the manufacture of packages in a flexible packaging material, for example a polymeric film, multilayer or the like.

The movement assembly according to the invention finds particular application in the technical field of packaging machines for packages of the "stand-up pouch" or "doypack" type, made from a flexible packaging material previously formed, in particular by calendering process and intended for the containment of fragile products, for example biscuits or similar.

BACKGROUND ART

The use of automatic packaging machines, in particular horizontal, equipped with movement assemblies for the manufacture of packages of the aforementioned type is known, in the technical field of reference.

In particular, the term "stand-up pouch" or "doypack" in the technical jargon of the sector identifies a type of package capable of being arranged, when placed on a substantially planar surface, according to a substantially vertical configuration (i.e. standing).

More specifically, such packages have a bottom portion whose shape is suitable to allow them to stand by themselves, in particular is substantially square or rectangular (commonly defined with the term "square bottom pouches" in the technical jargon of the sector).

Automatic packaging machines of known type mainly extend along a longitudinal packaging direction, and comprise a plurality of functional assemblies operatively associated with each other.

In more detail, these machines comprise:

- a feeding assembly configured to feed the machine with a flexible packaging material and convey said flexible material along the aforesaid longitudinal packaging direction;
- a forming assembly configured to receive the flexible packaging material from the feeding assembly and form/shape it, at least partially, so as to make a plurality of packages, for example having a substantially rectangular shaped bottom portion.
- a diverter assembly configured to pick up the multiplicity of packages made by the forming assembly and divert their path in such a way as to arrange each package along a filling direction that is transverse, in particular orthogonal, to the longitudinal packaging direction.

In particular, the diverter assembly arranges each package on a conveyor according to a substantially vertical configuration (i.e. standing) and with an opening of the package itself (i.e. an access mouth) arranged opposite to the bottom portion (i.e. facing upwards).

In addition, the diverter assembly orients each package such that a side with greater extension of the package itself is oriented substantially parallel to the longitudinal packaging direction.

In other words, the diverter assembly orients the packages in such a way that each of them advances on the conveyor along the longitudinal packaging direction with the respective long side being substantially parallel to the longitudinal direction thereof.

- a filling assembly oriented in accordance with the orientation of each package and configured to convey a predetermined amount of product at a side with main extension.
- a sealing assembly configured to seal the flaps of flexible packaging material at the access mouth in such a way as to make a package.

Known machines of the type just briefly described typically use a flexible packaging material previously formed by means of a forming tube. In particular, said forming tube is suitably shaped to be traversed by the flexible packaging material and shaped according to a predetermined shape and dimension.

Otherwise, automatic packaging machines are also known which use a flexible packaging material previously formed by calendering process.

In the latter case, the packaging machines comprise most of the aforementioned functional assemblies and in addition typically comprise a mechanical carousel. This mechanical carousel has a predetermined and fixed number of stations, each of which is configured to carry out at least one processing on the package being formed, for example opening, closing, pre-sealing of the package flaps.

More specifically, in order to carry out the aforesaid processings, the mechanical carousel typically comprises mainly mechanical actuating members, such as grippers, jaws and in general gripping elements.

The automatic packaging machines of known type so far briefly described have proved to be in practice not without drawbacks.

The main drawback lies in the fact that automatic packaging machines of known type are operatively inflexible. In fact, such machines are able to perform a limited number of processings on a package, in particular this number of processings is substantially equal to the number of functional assemblies present on the machine itself. It follows that, in order to perform processings on a package in addition to those carried out by the functional assemblies already present, it is necessary to equip the machine with corresponding functional assemblies. Therefore, it is evident that packaging machines of known type are rigid, since they must be specially designed to realize only a particular configuration of stand-up pouch type package.

In addition, a further drawback of automatic packaging machines of known type, in particular associated with the previous one, is that these machines are bulky, in particular due to the large number of functional assemblies mounted on the machine itself. For example, the extension of such machines may exceed 15 m in length. This entails the need to have large spaces in which to install the packaging machine.

A further drawback lies in the fact that automatic packaging machines of known type have poor production speeds. In fact, the functional assemblies mounted on such machines have a movement that is mainly performed with the aid of purely mechanical members, for example articulated kinematics and the like. This limits the production speed of the machine, in particular this speed generally does not exceed a maximum value typically comprised between 40÷45 packages/minute.

A further drawback lies in the fact that automatic packaging machines of known type are not able to adapt quickly to the manufacture of packages each having dimensions different from each other. In other words, machines of known type do not allow to make packages with different formats, and in particular the rapid transition from one format of a package to a different format (e.g. from a format of 400 g of product to a format of 500 g or similar).

A further drawback lies in the fact that automatic packaging machines of known type do not allow a homogeneous and even filling of the product inside a package being formed. In fact, as briefly mentioned above, these machines fill a package by inserting the product on one side of the package itself with greater extension. This creates a concentration of product in certain zones of the package, while adjacent zones are devoid of the product itself, thus creating a non-homogeneous distribution of product.

OBJECTS OF THE INVENTION

The object of the present invention is to provide a package movement assembly for an automatic packaging machine that makes it possible to obviate and remedy, at least in part, the drawbacks of the aforesaid prior art.

A further object of the present invention is to provide a package movement assembly that is operatively flexible, and specifically that allows to quickly switch from a package with one format (i.e. shape and dimensions of the package) to another package with a different format.

A further object of the present invention is to provide a packaging movement assembly having a high packaging speed, or at least a packaging speed higher than the maximum speed of the packaging machines of known type.

A further object of the present invention is to provide a package movement assembly that is compact and not bulky.

A further object of the present invention is to provide a package movement assembly that presents an alternative and/or improved configuration, both in constructive and functional terms, with respect to the traditional known solutions.

SUMMARY

In this context, the technical task underlying the present invention is to propose a package movement assembly for an automatic packaging machine, which obviates the drawbacks in the known art as described above.

In particular, the aforesaid objects are achieved with a movement assembly in accordance with the features set forth in claim 1.

The dependent claims outline particularly advantageous embodiments of the invention.

BRIEF DESCRIPTION OF THE DRAWINGS

Further features and advantages of the present invention will become more apparent from the indicative, and therefore non-limiting, description of a preferred but non-exclusive embodiment of an assembly for handling packages, as illustrated in the accompanying drawings in which.

With reference to the drawings, they serve solely to illustrate embodiments of the invention with the aim of better clarifying, in combination with the description, the inventive principles at the basis of the invention.

DETAILED DESCRIPTION OF THE INVENTION

With reference to the appended figures, a package movement assembly, subject-matter of the present invention, in particular intended to be operatively associated with an automatic packaging machine, has been indicated as a whole with number 10.

The term "packaging machine" shall therefore mean, for the purposes of this description, a machine, a plant, a line or any other automatic packaging system, preferably of the horizontal type (referred to as "HFFS—Horizontal Form Fill and Seal" in the technical jargon of the sector) and configured to make packages, preferably of the "stand-up pouch" or "doypack" type.

Each of the aforesaid packages has a conformation and in particular a preferably substantially square or rectangular bottom portion. In general, the aforesaid packages have at least one dimension having a main extension with respect to the other dimensions of the package itself.

However, the movement assembly 10 according to the packaging invention is capable of making packages having multiple conformations.

The term "movement" shall mean the transport, opening and/or closing of flaps of the aforesaid packages.

The term "flexible packaging material" shall mean any material, for example polymeric, paper or multi-layer type, suitable for being wrapped and sealed around a product, more generally to a quantity of product, to be packaged. In the following description, reference will preferably be made to a package preformed by calendering process. However, such a package may be preformed by using a forming tube, for example of the type used in an automatic vertical form fill and seal (VFFS) machine, known per se.

In addition, in the following description reference will be made to the packaging of fragile type products, in particular biscuits or the like. However, the movement assembly according to the invention can also be advantageously mounted on automatic packaging machines suitable for packaging products of other kind, such as candies, chocolates, nuts and peanuts, pet food, dairy products, and others.

Figure 1:
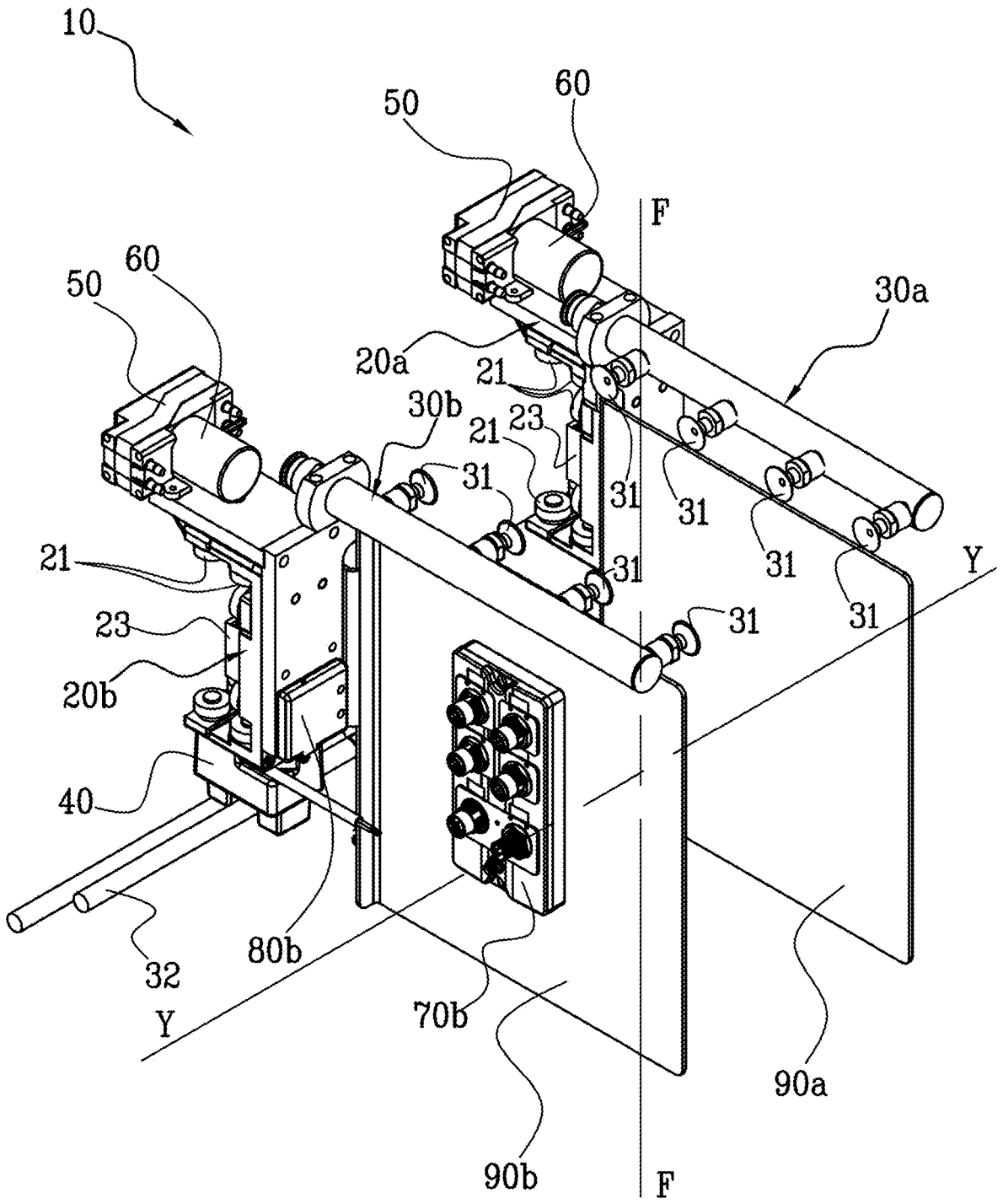
FIG. 1 shows, according to a perspective view, a package movement assembly for an automatic packaging machine according to a first embodiment of the invention.

In accordance with the embodiment illustrated in FIG. 1, the packaging movement assembly 10 for an automatic packaging machine comprises a first trolley 20*a* and a second trolley 20*b* placed side by side and slidably movable away from and/or towards each other along a packaging direction Y.

According to one aspect of the invention illustrated in FIGS. 1-4, the packaging direction Y is preferably oriented substantially horizontal, i.e. substantially parallel to the ground. However, said packaging direction Y can be arranged in accordance with a non-horizontal orientation, for example inclined by a predefined angle with respect to the aforesaid horizontal configuration.

According to one aspect of the invention, the first trolley 20*a* and the second trolley 20*b* comprise sliding elements 21, preferably bearings, in particular of the rolling type (e.g. ball or roller bearings), rotatably mounted on the first and second trolley 20*a*, 20*b* themselves, and configured to define a sliding type coupling with a sliding guide (not illustrated in the appended figures) in such a way that a movement of the first and second trolley 20*a*, 20*b* is allowed.

In particular, the sliding guide is preferably integral with a packaging machine, for example of the horizontal type, to which the movement assembly 10 is associated.

In other words, the sliding guide supports the first trolley 20*a* and the second trolley 20*b*, and therefore consequently the movement assembly 10.

According to one aspect of the invention, the sliding guide extends along an axis substantially parallel to the packaging direction Y, and has a shape of a substantially cross-section thereof that is constant along the aforesaid packaging direction Y.

According to one aspect of the invention, the first trolley 20*a* and the second trolley 20*b* have a substantially C-shape (see FIGS. 1 and 2), in such a way that a substantially rigid and robust anchoring to the outer profile of the sliding guide is allowed.

Figure 2:
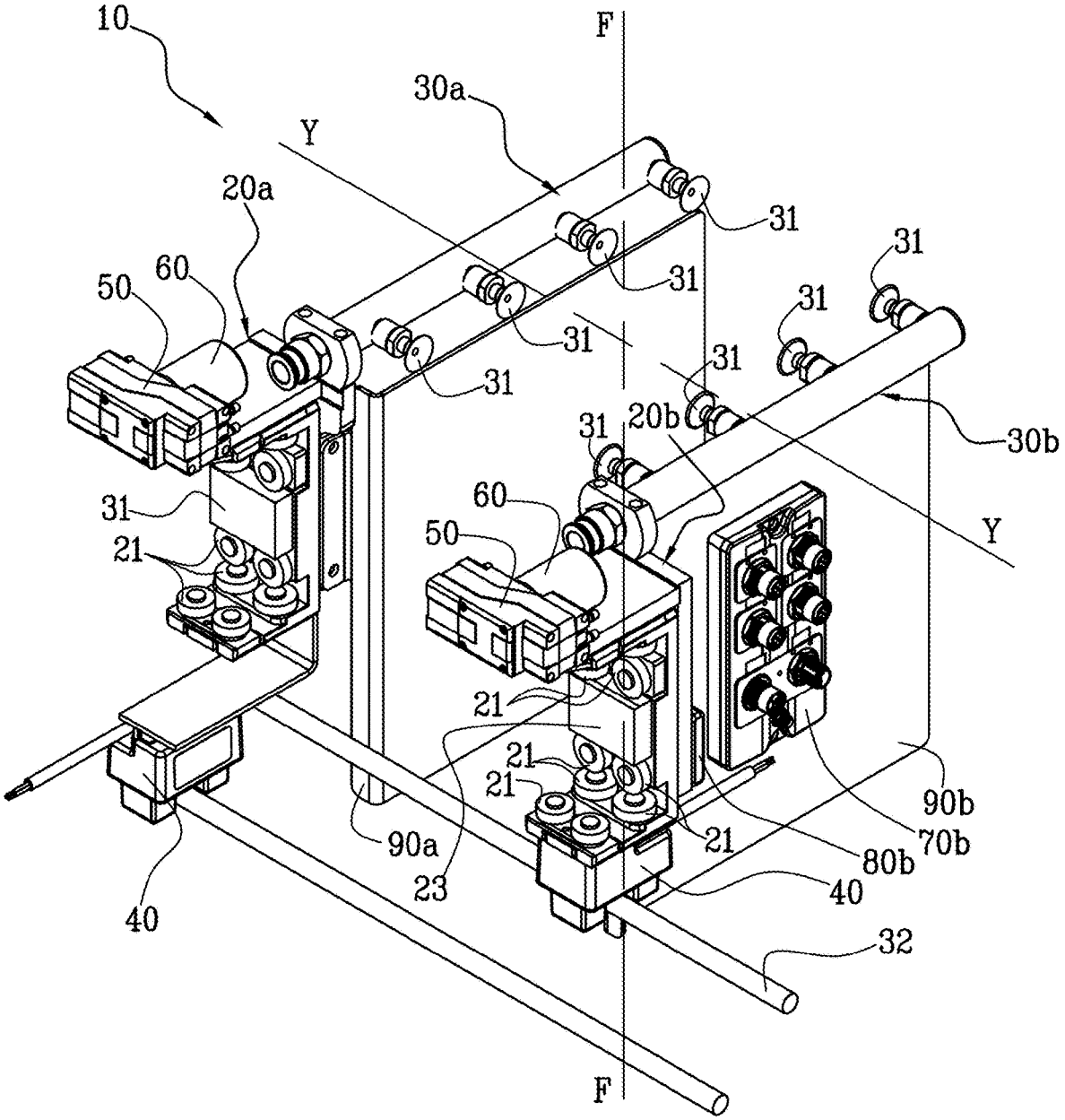
FIG. 2 shows, according to a further perspective view, the movement assembly illustrated in FIG. 1.

According to one aspect of the invention, illustrated in detail in FIG. 1-2, the first trolley 20*a* and the second trolley 20*b*, in a configuration constrained to the sliding guide, are arranged cantilevered with respect to the sliding guide itself. In other words, the first trolley 20*a* and the second trolley 20*b* protrude outwards with respect to the slide guide.

Figure 3:
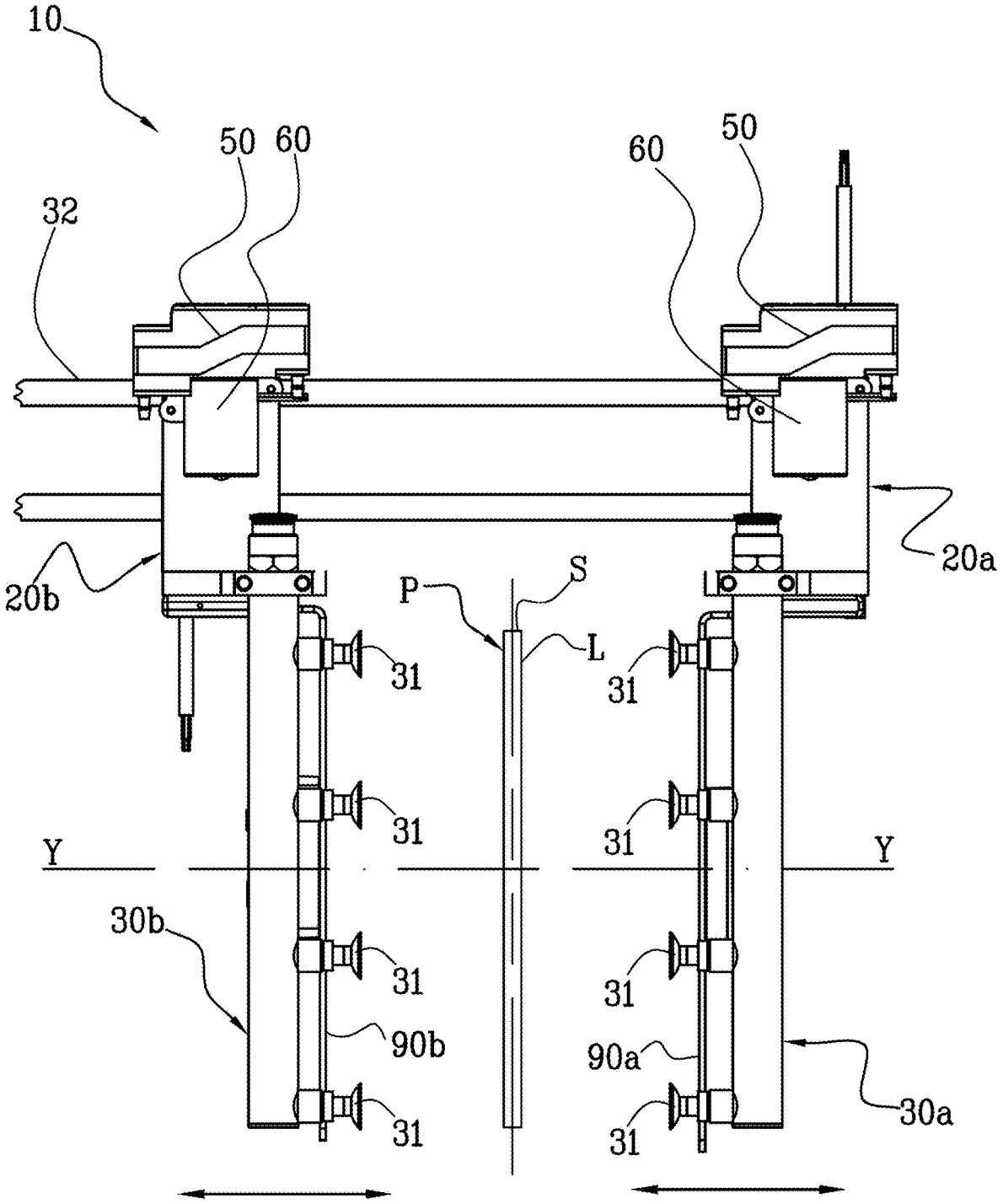
FIG. 3 shows, according to a top plan view, the movement assembly illustrated in FIG. 1.
Figure 4:
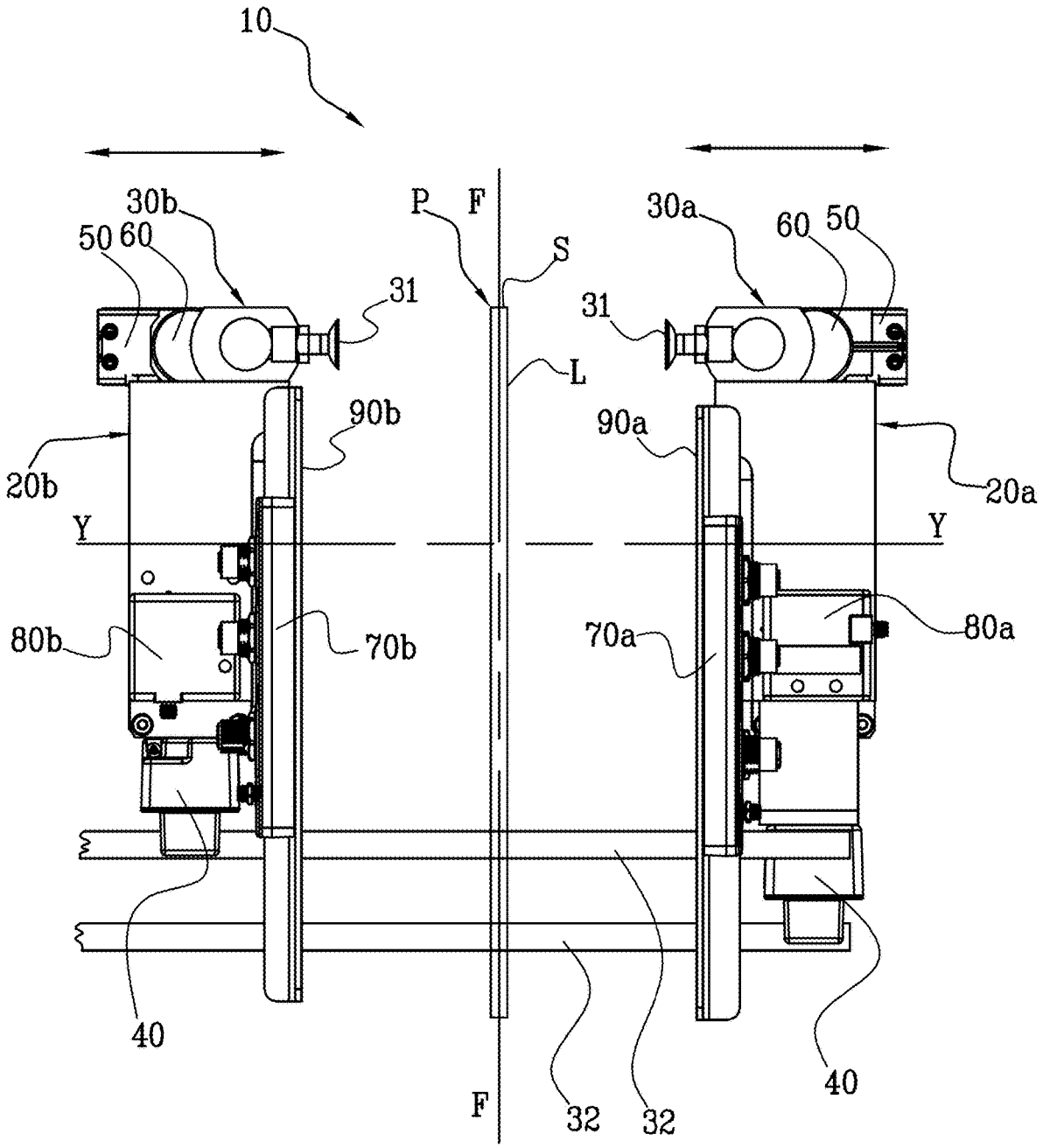
FIG. 4 shows, according to a front plan view, the movement assembly illustrated in FIG. 1.
Figure 5:
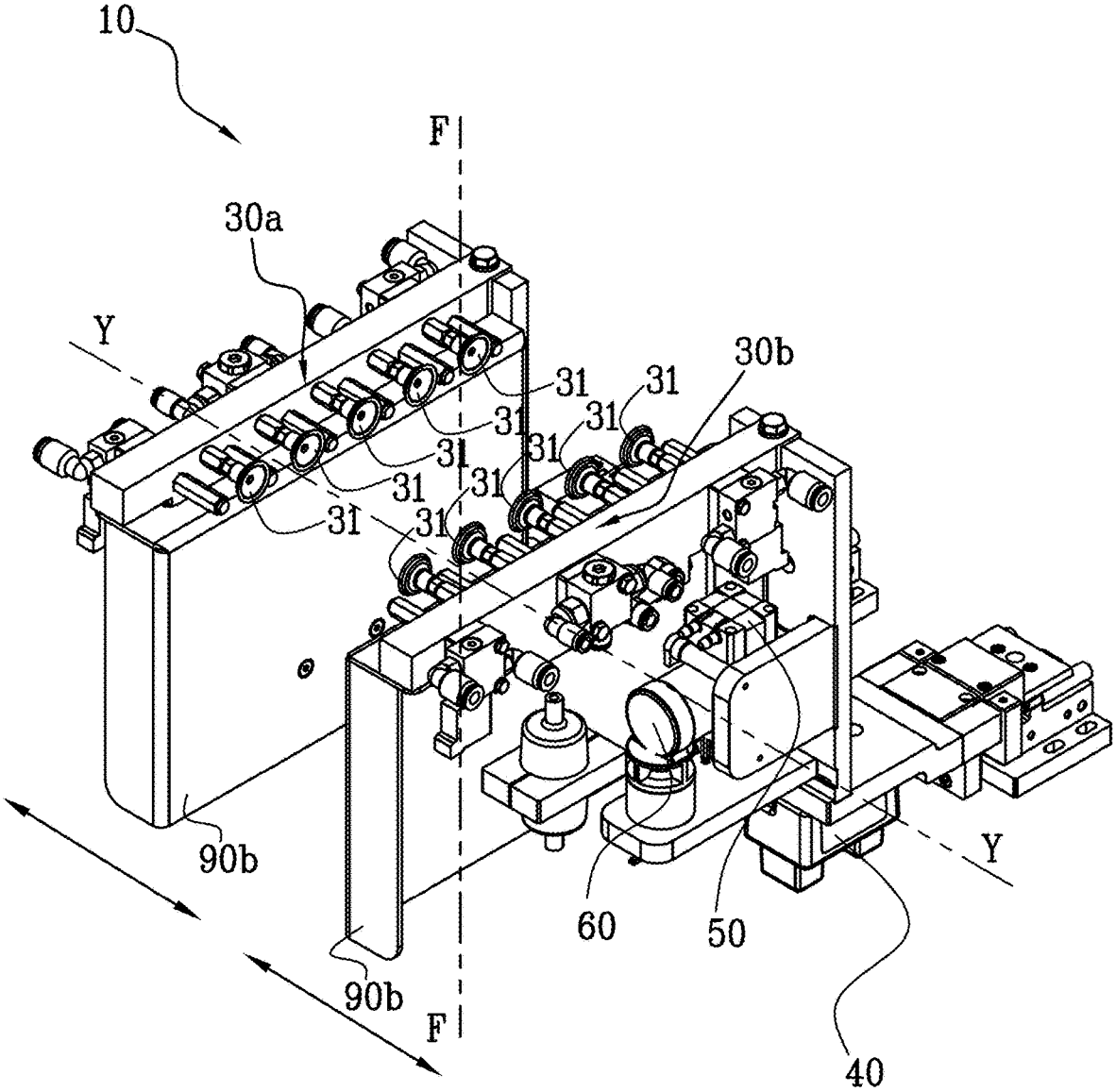
FIG. 5 shows, according to a perspective view, a package movement assembly for a packaging machine in accordance with a second embodiment of the invention.
Figure 6:
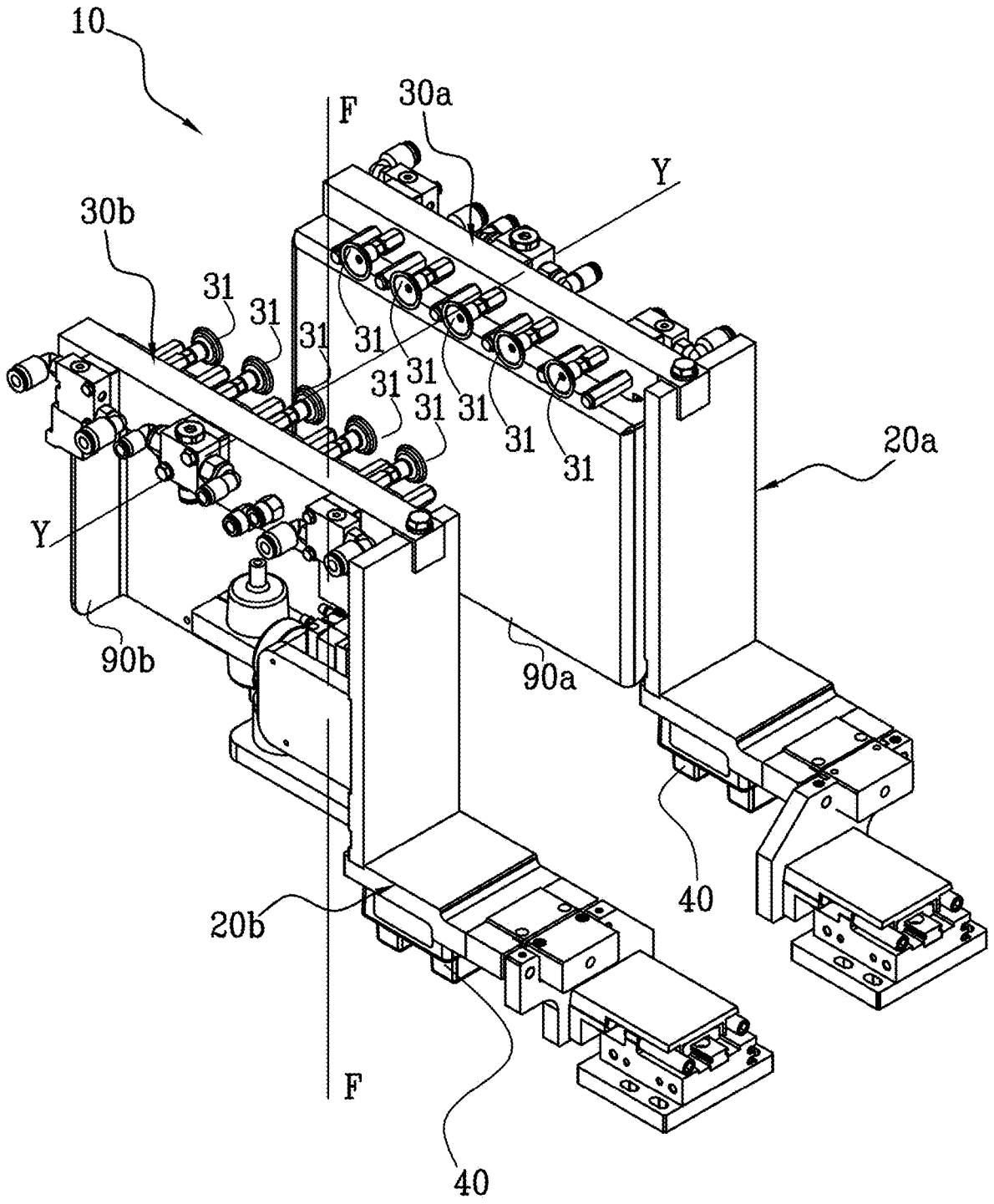
FIG. 6 shows, according to a perspective view, the movement assembly illustrated in FIG. 5 according to a rear view.

In accordance with the embodiment illustrated in the appended figures, the movement assembly 10 further comprises a first gripping device 30*a* and a second gripping device 30*b* facing each other and between which a package P to be moved can be positioned (see FIG. 3).

More in detail, the first gripping device 30*a* and the second gripping device 30*b* are configured to grip respective flaps of a package and at least open and/or close such flaps, in particular to allow a filling of the package itself.

In particular, each package comes for example from a package feeding assembly or station (not illustrated in the appended figures), in particular arranged upstream of the movement assembly. This feeding assembly is configured to introduce each package P, in the volume between the first trolley 20*a* and the second trolley 20*b*, along a feeding direction F-F that is transverse, preferably orthogonal, to the packaging direction Y (see FIGS. 3 and 4).

More specifically, the feeding assembly introduces into the volume defined between the first and second trolley 20*a*, 20*b* from above downwards each package P along the feeding direction F-F, i.e. starting from a raised position arranged above the first and second trolley 20*a*, 20*b*, towards a lowered position interposed between the first and second trolley 20*a*, 20*b* thereof.

In addition, as depicted in detail in FIG. 3, the feeding assembly arranges each package P oriented with a long side thereof L substantially orthogonal to the packaging direction Y.

Conversely, the short side S of each package P is oriented substantially parallel to the packaging direction Y (see FIG. 3).

In particular, the first trolley 20*a* and the second trolley 20*b* with the respective first gripping devices 30*a* and second gripping device 30*b* pick up and move each package P with a short side thereof S arranged parallel to the packaging direction Y. The configuration just described allows a filling of each package P along a direction substantially orthogonal to the packaging direction Y, i.e. along a feeding direction F-F substantially parallel to the aforesaid short side.

Advantageously, the filling at the short side S is substantially homogeneous, as well as allowing a constructive simplification of the movement assembly 10 and consequently of the associated packaging machine. In fact, the configuration just described above makes it possible to obtain a compact machine that is not bulky.

In accordance with the embodiment illustrated in FIGS. 1-4, the first gripping device 30*a* and the second gripping device 30*b* are mechanically mounted respectively on the first trolley 20*a* and on the second trolley 20*b*. In particular, the first gripping device 30*a* and the second gripping device 30*b* are movable, towards and/or away, along a direction substantially parallel to the packaging direction Y in such a way as to open and/or close the flaps of each package along the packaging direction Y itself.

In other words, the first gripping device 30*a* and the second gripping device 30*b* extend mainly along a direction substantially orthogonal to the packaging direction Y.

According to one aspect of the invention, the first gripping device 30*a* and the second gripping device 30*b* are mechanically constrained respectively to the first trolley 20*a* and to the second trolley 20*b*, for example by fixing elements, such as in particular screws or the like.

In this way, the first gripping device 30*a* and the second gripping device 30*b* are integral with the first trolley 20*a* and with the second trolley 20*b* during movement along the packaging direction Y. In addition, the first trolley 20*a* and the second trolley 20*b* are independently movable with respect to each other.

Advantageously, the movement assembly 10 is flexible, as it allows moving packages P having dimensions, and therefore formats, different from each other. In particular, this movement takes place in a simple way, i.e. without the aid of additional equipment and implements to be connected to the aforesaid movement assembly 10.

Advantageously, the first and second trolley 20*a*, 20*b* retain the flaps of each package P since it is picked up until the package P itself is unloaded from the packaging machine, once sealed.

In other words, the gripping elements 31 of the first and second trolley 20*a*, 20*b* retain each package P along substantially the entire extension of the packaging direction Y without stopping gripping the package P itself and move each package P through the various packaging steps (such as those described above). It follows that the packaging machine is compact as it does not require a large number of functional stations or assemblies each adapted to carry out a predefined processing on the packaging P itself corresponding to a predefined packaging step.

According to one aspect of the invention, the first trolley 20*a* and the second trolley 20*b* can be actuated along the packaging direction Y by means of electromagnetic means.

More in detail, the electromagnetic means comprises a magnet 23, for example a permanent magnet. In particular, said permanent magnet 23 is preferably mechanically mounted on each trolley 20*a*, 20*b* and is configured to interact with the aforesaid sliding guide.

The coupling just described, i.e. the interaction between the magnet 23 and the sliding guide, defines a linear type motor (known to the person skilled in the art and therefore not further described).

According to one aspect of the invention, each of the trolleys 20*a*, 20*b* comprises a respective power generator adapted to generate a predetermined amount of electric power.

In particular, each electric power generator comprises an electric cable 32 extending substantially parallel to the packaging direction Y between the trolleys 20*a*, 20*b* and configured to be crossed by a predefined flow of electric current.

The power generator further comprises a receiver 40 mechanically mounted on each trolley 20*a*, 20*b*, and adapted to produce an electric power by electromagnetic effect.

More specifically, the electric cable 32 and the receiver 40 of each trolley 20*a*, 20*b* are operatively associated in such a way as to produce a predefined flow of electric current induced respectively on board the first trolley 20*a* and the second trolley 20*b*.

Advantageously, the power generator allows to generate on board each trolley 20*a*, 20*b* a predefined amount of electrical power, for example usable to electrically power a plurality of components, in particular introduced and described below.

In this way, each trolley 20*a*, 20*b* is essentially a movable power station, at least along the packaging direction Y.

In accordance with the embodiment illustrated in the appended FIGS. 1-4, the first gripping device 30*a* and the second gripping device 30*b* each comprise a plurality of gripping elements 31.

As illustrated in the appended figures, each gripping element 31 of the first gripping device 30*a* is operatively associated with a corresponding gripping element 31 of the second gripping device 30*b*.

In other words, the respective gripping elements 31 mounted on the first trolley 20*a* and on the second trolley 20*b* are arranged in pairs, i.e. for each gripping element 31 belonging to the first trolley 20*a* there is a corresponding gripping element 31 belonging to the second trolley 20*b* and facing the previous gripping element 31.

As illustrated in the appended figures, the gripping elements 31 are in fluid communication with each other, and are arranged mounted on the first and second gripping device 30*a*, 30*b* along a direction transverse to the packaging axis Y.

In other words, each gripping member 31 as well as the first and second gripping devices 30*a*, 30*b* are mounted cantilevered on the first and second trolley 20*a*, 20*b*.

Preferably, the gripping elements 31 are arranged mounted in succession to each other on the first and second gripping device 30*a*, 30*b*, in particular preferably positioned to each other at regular distance stretches (i.e. equally spaced along said transverse direction).

Figure 7:
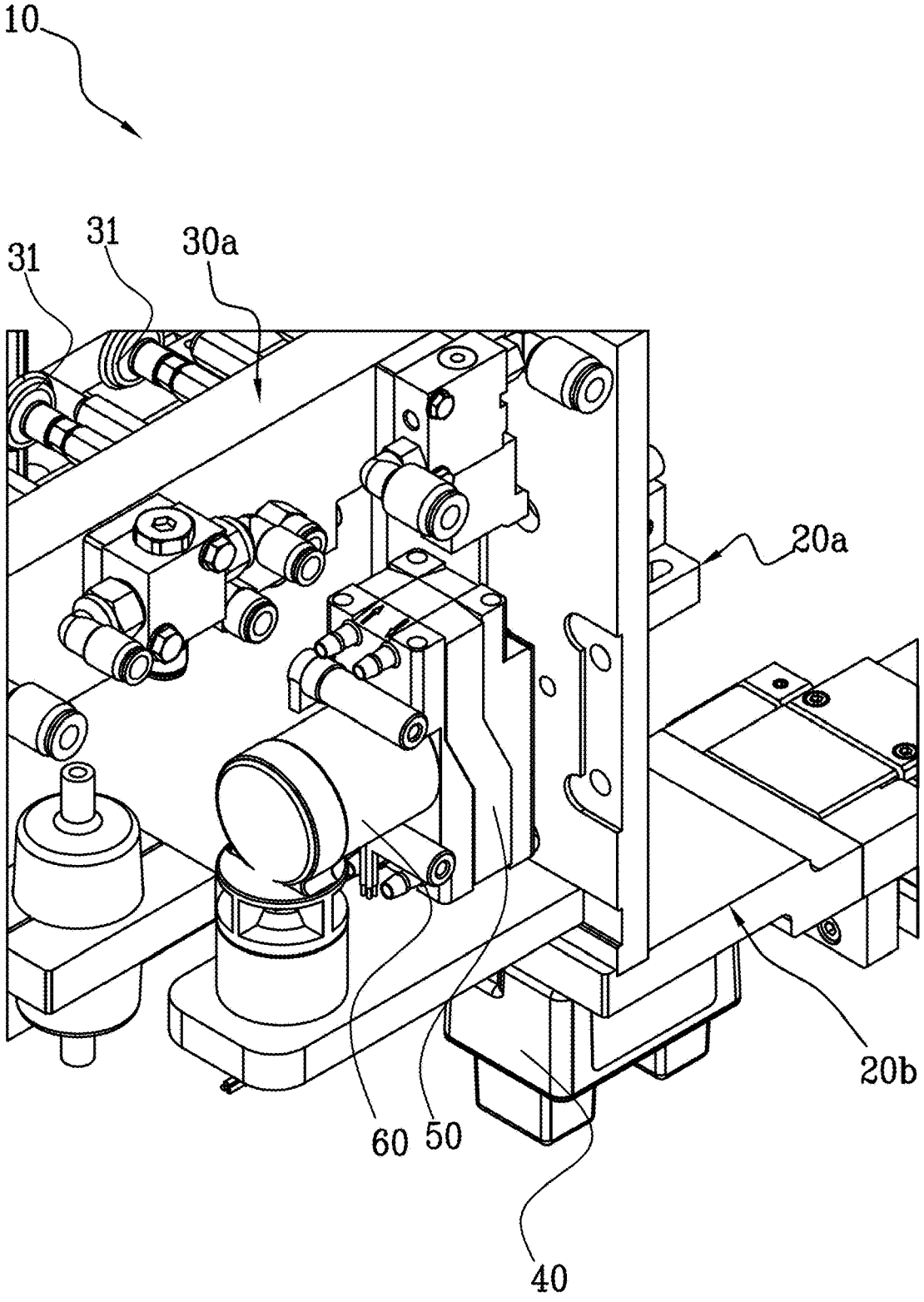
FIG. 7 shows, according to a perspective view, an enlarged detail zone of the movement assembly illustrated in FIG. 5.
Figure 8:
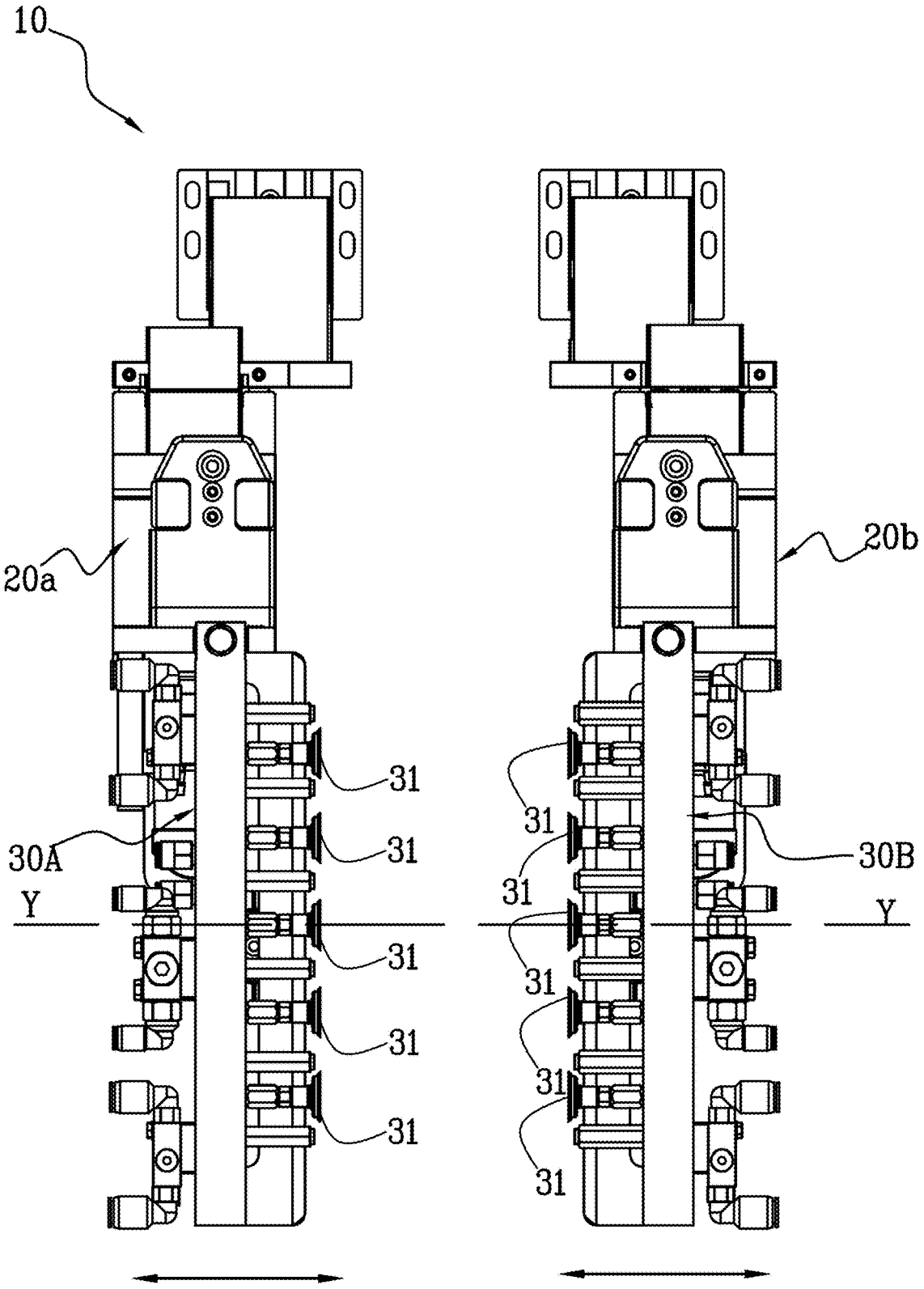
FIG. 8 shows, according to a top plan view, the movement assembly illustrated in FIG. 5.

According to the embodiment illustrated in the appended FIG. 7, the gripping elements 31 of the plurality of gripping elements preferably comprise pneumatic suction cups.

According to the illustrated embodiment, the first trolley 20*a* and the second trolley 20*b* each comprise four pneumatic suction cups.

Preferably, the gripping elements 31 are substantially equal to each other.

In accordance with the embodiment illustrated in the appended figures, the first trolley 20*a* and the second trolley 20*b* respectively comprise a vacuum pump 50, associated with the respective gripping device 30*a*, 30*b*, in fluid connection with the plurality of gripping elements 31, and configured to generate a depression at an active zone of each gripping element 31.

Preferably, the vacuum pump 50.

The first trolley 20*a* and the second trolley 20*b* further comprise an electric motor 60 mechanically connected to the vacuum pump 50 and configured to actuate it.

Preferably, the electric motor 60 is directly connected to the vacuum pump 50, and preferably of the brushless type.

In accordance with one embodiment of the invention not illustrated in the appended figures, the first gripping device 30*a* and the second gripping device 30*b* comprise respective adjustment means (not illustrated in the appended figures) configured to adjust the actuation of each gripping element 31 independently with respect to the other gripping elements 31.

Advantageously, the independent movement of each trolley 20*a*, 20*b* along the packaging direction Y, allows modulating the transit of the number of packages along the aforesaid direction, in such a way as to allow an adjustment and/or adaptation of the movement assembly 10 and therefore of the packaging machine with which it is associated, of the production of packages in the unit of time, for example a production of the batch type.

In other words, the movement assembly 10 makes it possible to create accumulation zones for packages arranged along the packaging direction Y, commonly referred to as "buffers" in the technical jargon of the sector. These package accumulation zones allow to accommodate a predefined number of packages being formed, in such a way as to form groups of packages. At the end of a preselected time interval, each group of packages is moved by a trolley and continues its movement along the packaging direction Y.

In this way, the packaging machine equipped with the movement assembly 10 allows to produce groups of packages comprising a predefined and preselected number of packages in such a way as to adapt to production requirements.

In particular, these adjustment means comprises adjustment valves, in particular solenoid valves, mechanically mounted on the first trolley 20*a* and on the second trolley 20*b*, configured to activate and/or deactivate a predefined gripping element 31.

Operatively, the aforesaid solenoid valves activate and/or deactivate a predefined number of gripping elements 31 on each trolley 20*a*, 20*b*. In particular, the number of gripping elements 31 activated by the solenoid valves is a function of the dimensions, in particular of the extension of the long side L of each package P (see FIG. 3).

Preferably, each trolley 20*a*, 20*b* carries two solenoid valves mounted thereon.

In accordance with one embodiment of the invention not illustrated in the appended figures, the first gripping device 30*a* and the second gripping device 30*b* may each comprise electromechanical kinematics, mounted on the first and second trolley 20*a*, 20*b* and configured to open and/or close the flaps of each package P.

More specifically, the electromechanical kinematics may preferably comprise a lever mechanism or linkage, for example of the quadrilateral or thrust crank type or the like, mechanically connected to a gear reducer, for example of the epicyclic type.

In addition, the electromechanical kinematics comprises an electric motor, for example of the brushless type, mechanically connected to the gear reducer and configured to actuate the gear reducer in rotation and therefore consequently activate the movement of the aforesaid lever mechanism.

The movement assembly 10 further comprises a first control unit 70*a* and a second control unit 70*b* operatively associated with the first gripping device 30*a* and the second gripping device 30*b*, and configured at least to activate the corresponding gripping device 30*a*, 30*b*.

According to one aspect of the invention, the first control unit 70*a* and the second control unit 70*b* are connected to the respective electric motor 60 and to the respective electric power generator, for example by means of an electric cable.

According to one aspect of the invention, the first control unit 70*a* and the second control unit 70*b* are of the multi-port type (see FIGS. 1 and 2).

According to one aspect of the invention, the first trolley 20*a* and the second trolley 20*b* each comprise respective antennas 80*a*, 80*b* operatively associated with the control units 70*a*, 70*b* thereof for sending command signals generated by a remote station with respect to the movement assembly 10.

According to one aspect of the invention, each antenna 80*a*, 80*b* is connected to the corresponding control unit 70*a*, 70*b*, preferably by means of an electrical cable.

The aforesaid remote station can be arranged in a position proximal (or close) to the movement assembly 10, for example said station can be positioned inside or outside an electrical control panel of a packaging machine with which the movement assembly 10 is associated.

More in detail, the remote station may comprise a control device, preferably at least one PLC (Programmable Logic Controller) or the like, configured to exchange signals, in particular receive, process and send signals, with the aforesaid antennas 80*a*, 80*b*.

According to one aspect of the invention, each antenna 80*a*, 80*b* is of the wireless type and configured to receive the control signals wirelessly.

Advantageously, the movement assembly 10 and consequently the packaging machine on which the assembly 10 is mounted does not require long and cumbersome electrical connection cables. In this way, each trolley 20*a*, 20*b* is able to carry out movement operations (i.e. moving forward and backward along the packaging direction Y, opening and closing the flaps of each package P) regardless of the position in which it is located. This results in improved flexibility of the movement assembly 10 and of the associated packaging machine.

According to one aspect of the invention, the movement assembly 10 comprises a first plate 90*a* connected to the first trolley 20*a* and a second plate 90*b* connected to the second trolley 20*b* (see FIGS. 1 and 2).

More specifically, the first plate 90*a* and the second plate 90*b* each extend substantially orthogonal to the packaging direction Y so as to compartmentalize the package in the volume defined between the first trolley 20*a* and said second trolley 20*b*.

Advantageously, each package P remains in a configuration substantially parallel to the feeding direction F-F, i.e. substantially rectilinear and vertical, during its movement. In other words, the first plate 90*a* and the second plate 90*b* prevent the formation of oscillations and/or pendulations by each package P during its movement along the packaging direction Y.

As illustrated in FIGS. 1 and 2, the first and second control unit 70*a*, 70*b* are preferably mounted on the first and second plate 90*a*, 90*b*.

The present invention also relates to a packaging machine (not illustrated in the appended figures) comprising a sliding guide (not illustrated in the appended figures) extending mainly along the packaging direction Y. The packaging machine comprises at least one package movement assembly 10 slidably connected to the sliding guide, having one or more of the characteristics described above.

In accordance with a second embodiment, illustrated in particular in the appended FIGS. 4-8, the movement assembly 10, comprises reception means mounted on the first trolley 20*a* and on the second trolley 20*b*, and connection means configured to be reversibly engaged with the aforesaid reception means.

More in detail, the connection means is movable by an actuator between a rest configuration in which the reception means is distal from the connection means, and an engagement configuration in which the reception means is coupled with the connection means to define a closed electrical circuit so as to command the first gripping device 30*a* and the second gripping device 30*b*.

Preferably, the actuator comprises a cylinder, for example a pneumatic or electro-magnetic cylinder, mechanically mounted on the sliding guide and positionable in multiple predefined fixed positions.

According to one aspect of the invention, the connection means preferably comprises spring-loaded connectors.

According to one aspect of the invention, the reception means preferably comprises a printed circuit board of the PCB type (i.e. "Printed Circuit Board").

Preferably, the reception means, and therefore the PCB, is connected to the remote station, in particular to at least one PLC (Programmable Logic Controller) or the like (introduced above), in such a way as to allow the exchange of a signal between the PLC and the PCB.

Operatively, the first trolley 20*a* reaches a position proximal to the actuator. Subsequently, with the first trolley 20*a* in this position, the actuator is moved in such a way as to bring into contact (i.e. in such a way as to allow a coupling) the spring-loaded connectors with contact zones of the printed circuit board PCB, in such a way as to allow an electrical connection and therefore a closed circuit through which there is a passage of electric current, and therefore of a signal (as described above).

The signal coming and transmitted from/by the PLC to the PCB is on board the first trolley 20*a*. In this way, with a signal on board the first trolley 20*a*, it is possible to command the activation and/or shutdown of the electric motor 60 and therefore of the vacuum pump 50 to which it is connected. As a result, the first gripping device 30*a*, i.e. the gripping elements 31, for example pneumatic suction cups, is activated and/or shut down.

In accordance with a third embodiment, not illustrated in the appended figures, the package movement assembly 10 has mounted on each trolley, in particular on the first trolley 20*a* and on the second trolley 20*b*, two gripping devices 30*a*, 30*b*. In other words, the first gripping device 30*a* and the second gripping device 30*b* are both mounted on the first trolley 20*a*.

In addition, the movement assembly 10 comprises a third gripping device and a fourth gripping device entirely similar to the first and second gripping device 30*a*, 30*b*, and respectively mounted on the second trolley 20*b*.

The present invention also relates to a method for moving packages for automatic packaging machines of the type described above and whose same numerical references will be maintained for simplicity of exposure.

The method in question comprises the following operating steps:

providing a package to be filled between a first trolley 20*a* and a second trolley 20*b* of a movement assembly 10. In particular, the package is at least partially sealed and defines a substantially planar element arranged orthogonally to a packaging direction Y along which the first trolley 20*a* and the second trolley 20*b* are mutually movable;

approaching the first trolley 20*a* and the second trolley 20*b* in such a way that a first and a second gripping device 30*a*, 30*b* come into contact with the flaps of the package;

activating each first gripping device 30*a* and second gripping device 30*b* so as to retain the flaps;

moving the packaging along the packaging direction Y;

moving the first trolley 20*a* and the second trolley 20*b* away in such a way as to move the flaps of the package away to create an insertion mouth;

inserting a predefined quantity of product along a direction substantially orthogonal to the packaging direction Y;

moving the first trolley 20*a* and the second trolley 20*b* towards each other in such a way as to bring the flaps closer together until said package is closed;

sealing the flaps of the package;

releasing the sealed package, for example at a zone where the packages are unloaded from the packaging machine.

From what has been described it is clear that the movement assembly for a packaging machine, according to the invention, is particularly advantageous in that:

it is capable of overcoming, at least partially, the drawbacks of the prior art mentioned above;

it is compact and/or not very bulky, in fact it has a plurality of devices mounted thereon, allowing a considerable saving in terms of total space occupied by the packaging machine on which the assembly itself is mounted;

it allows to retain the flaps of a package being processed along the packaging direction Y, in particular since it is picked up until it is released/unloaded;

it moves each package by orienting it with a long side thereof substantially orthogonal to the packaging direction, in such a way that a filling at the short side of each package is allowed;

The invention claimed is:

1. A package movement assembly for an automatic packaging machine, comprising:

a first trolley and a second trolley placed side by side one another and slidably movable away from and/or towards each other along a packaging direction;

a first gripping device and a second gripping device facing each other and between which a package to be moved can be positioned;

the first gripping device and the second gripping device being configured to grip respective flaps of the package and open and/or close said flaps;

wherein the first gripping device and the second gripping device are mechanically mounted respectively on the first trolley and on the second trolley;

wherein the first gripping device and the second gripping device are movable along a direction substantially parallel to the packaging direction in such a way as to open and/or close the flaps of the package along the packaging direction; and wherein the first trolley and the second trolley each comprise a plurality of gripping elements as well as:

a vacuum pump, associated with a respective gripping device, in fluid connection with the plurality of gripping elements, and configured to generate a depression at an active zone of each gripping element;

an electric motor mechanically connected to the vacuum pump and configured to actuate it;

a first power generator associated to the first trolley and a second power generator associated to the second trolley, the first power generator and the second power generator being adapted to generate a predeterminer predetermined amount of electric power;

a first reception element mounted on the first trolley and a second reception element mounted on the second trolley; and connection elements configured to be reversibly engaged with the reception elements;

wherein the connection elements are movable by an actuator between a rest configuration in which the reception elements are distal from the connection elements, and an engagement configuration in which the reception elements are coupled with the connection elements to define a closed electrical circuit so as to command the first gripping device and the second gripping device.

2. The movement assembly of claim 1, wherein the first trolley and the second trolley are independently movable with respect to each other, and wherein the first trolley and the second trolley are actuatable along the packaging direction by means of an electromagnetic element.

3. The movement assembly of claim 1, wherein each electrical power generator comprises:

an electric cable extending substantially parallel to the packaging direction between the trolleys and configured to be crossed by a predefined flow of electric current;

a receiver mechanically mounted on each trolley, and adapted to produce an electric power by electromagnetic effect, the electric cable and the receiver of each trolley being operatively associated in such a way as to produce a predefined flow of electric current induced respectively on board the first trolley and the second trolley.

4. The movement assembly of claim 1, wherein the first gripping device and the second gripping device comprise respective adjustment elements configured to adjust the actuation of each gripping element independently with respect to other gripping elements.

5. The movement assembly of claim 1, wherein each gripping element of the first gripping device is operatively associated with a corresponding gripping element of the second gripping device.

6. The movement assembly of claim 1, wherein the gripping elements are in fluid communication with each other, and are arranged mounted on the first and second gripping devices along a direction transverse to a packaging axis.

7. The movement assembly of claim 1, comprising a first control unit and a second control unit which are operatively associated with the first gripping device and the second gripping device, and which are configured at least to activate a corresponding gripping device.

8. The movement assembly of claim 7, wherein the first control unit and the second control unit are connected to the respective electric motor and to the respective electric power generator, wherein the first trolley and the second trolley each comprise respective antennas operatively associated with the first control unit and the second control unit for sending command signals generated by a remote station with respect to the movement assembly.

9. The movement assembly of claim 8, wherein each antenna is of a wireless type and configured to receive the command signals wirelessly.

10. The movement assembly of claim 1, wherein the connection element comprises at least one spring-loaded connector.

11. The movement assembly of claim 1, wherein the reception elements comprises a printed circuit board.

12. The movement assembly of claim 1, comprising a first plate connected to the first trolley and a second plate connected to the second trolley, the first plate and the second plate each extending substantially orthogonal to the packaging direction so as to compartmentalize the package in a volume defined between the first trolley and the second trolley.

13. A packaging machine comprising a sliding guide extending mainly along a packaging direction, comprising at least one package movement assembly for an automatic packaging machine, comprising:

a first trolley and a second trolley placed side by side one another and slidably movable away from and/or towards each other along a packaging direction;

a first gripping device and a second gripping device facing each other and between which a package to be moved can be positioned;

the first gripping device and the second gripping device being configured to grip respective flaps of the package and at least open and/or close said flaps;

wherein the first gripping device and the second gripping device are mechanically mounted respectively on the first trolley and on the second trolley;

wherein the first gripping device and the second gripping device are movable along a direction substantially parallel to the packaging direction in such a way as to open and/or close the flaps of the package along the packaging direction; and wherein the first trolley and the second trolley each comprise a plurality of gripping elements as well as:

a vacuum pump, associated with a respective gripping device, in fluid connection with the plurality of gripping elements, and configured to generate a depression at an active zone of each gripping element;

an electric motor mechanically connected to the vacuum pump and configured to actuate it;

a first power generator associated to the first trolley and a second power generator associated to the second trolley, the first power generator and the second power generator being adapted to generate a predetermined amount of electric power;

a first reception element mounted on the first trolley and a second reception element mounted on the second trolley; and connection elements configured to be reversibly engaged with the reception elements;

wherein the connection elements are movable by an actuator between a rest configuration in which the reception elements are distal from the connection elements, and an engagement configuration in which the reception elements are coupled with the connection elements to define a closed electrical circuit so as to command the first gripping device and the second gripping device.

* * * * *